United States Patent [19]

Hikai et al.

[11] 3,951,088

[45] Apr. 20, 1976

[54] BUILDING EQUIPMENT FOR SHIPS' HULLS

[75] Inventors: Akio Hikai, Shimizu; Kazuo Nishikawa, Yokohama, both of Japan

[73] Assignee: Nippon Kokan Kabushiki Kaisha, Tokyo, Japan

[22] Filed: May 27, 1975

[21] Appl. No.: 580,706

[30] Foreign Application Priority Data

July 9, 1974 Japan ..... 49-77867

[52] U.S. Cl. ..... 114/65 R; 61/64; 114/77 R

[51] Int. Cl.[2] ..... B63B 3/02

[58] Field of Search ..... 114/77 R, 77 A, 65 R; 61/64

[56] References Cited

UNITED STATES PATENTS

| | | | |
|---|---|---|---|
| 3,429,288 | 2/1969 | Suit | 114/77 R |
| 3,489,118 | 1/1970 | Sugizaki et al. | 114/65 R |
| 3,656,446 | 4/1972 | Hefferman | 114/77 R |
| 3,742,889 | 7/1973 | Weise et al. | 114/65 R |

*Primary Examiner*—Trygve M. Blix
*Assistant Examiner*—Stuart M. Goldstein
*Attorney, Agent, or Firm*—Flynn & Frishauf

[57] ABSTRACT

Building equipment for a hull comprising a hull joining stage having a bottom surface level flush with the ground level of the site; a stern building stage having a bottom surface level flush with that of the hull joining stage, provided at a longitudinal end of the hull joining stage so as to be adjacent thereto through a gate; a bow and parallel body building stage having a bottom surface level flush with that of the hull joining stage, provided at the other longitudinal end of the hull joining stage so as to be adjacent thereto through another gate; a pond having a bottom surface lower than that of the hull joining stage, provided longitudinally in parallel with and adjacent to the hull joining stage on the water side, a longitudinal end of the pond being open to a body of water through still another gate; cranes travelling linearly along the hull joining stage, the stern building stage and the bow and parallel body building stage; and partition walls higher than the ground level and the level of the body of water, comprehensively enclosing the hull joining stage and the pond in water-tight manner in conjunction with the three gates. The building equipment for a hull covers also a combination comprising the bow and parallel body building stage divided into two parts, namely: a bow building stage and a parallel body building stage.

2 Claims, 4 Drawing Figures

BUILDING EQUIPMENT FOR SHIPS' HULLS

FIELD OF THE INVENTION

This invention relates to building equipment for building hulls in large quantities.

BACKGROUND OF THE INVENTION

Building equipment for building hulls in large quantities, as shown in FIG. 4, is known. FIG. 4 shows two docks of the one-sided opening type arranged in parallel with each other open to and at right angles to a body of water such as a sea, lake or river.

In this conventional building equipment for a hull, building of hulls is effected by: building a stern A in a stern building stage 13 of one of the two docks according to FIG. 4; building the remaining parts of the hull, i.e., a bow F and a parallel body M and, at the same time, joining both in a bow and parallel body building stage 14 of the other dock; transferring said stern A built in said stern building stage 13 of the one dock from said stern building stage 13 to a hull joining stage 12 through an opened gate 13*a* by the use of transfer means such as cranes and carriages; causing said bow and said parallel body F + M joined in said bow and parallel body building stage 14 of the other dock to float by introducing water from the body of water into the dock, and transferring by water said bow and parallel body F + M from said bow and parallel body building stage 14 to said hull joining stage 12 through opened gates 14*a* and 12*a;* removing the water in the dock from said hull joining stage 12 and joining said stern A to said bow and parallel body F + M to complete building of the hull; causing the completed hull to float by pouring water into the dock and towing out said hull onto the body of water through the opened gate 12*a;* and, at the same time, with the above-mentioned steps, effecting the building of the bow, parallel body and stern of another vessel in accordance with the above-mentioned steps.

Although the above-mentioned conventional building equipment for a hull is suitable for building hulls in large quantities, it is necessary to provide both docks with various devices necessary for building hulls, e.g., cranes. Besides, on transferring by water the joined bow and parallel body F + M, the operation is sometimes hindered by the influence of the weather such as winds and waves, thus requiring much time and labor.

SUMMARY OF THE INVENTION

Therefore, one object of this invention is to provide building equipment for a hull for building hulls in large quantities which is substantially free of the effect of the weather such as winds and waves by avoiding transferring by water each part of a hull.

Another object of this invention is to provide a building equipment for hulls for building hulls in large quantities which requires only a minimum number of various devices necessary for building hulls, e.g., gantry cranes by arranging stages where each part of a hull is built and joined together and a pond in a rational manner.

The building equipment for hulls of this invention is characterized by a combination comprising a hull joining stage having a horizontal bottom surface level flush with the ground level of the site; a stern building stage having a horizontal bottom surface level flush with the bottom surface of said hull joining stage, provided at a longitudinal end of said hull joining stage so as to be adjacent thereto through a gate; a bow and parallel body building stage having a horizontal bottom surface level flush with the bottom surface of said hull joining stage, provided at the other longitudinal end of said hull joining stage so as to be adjacent thereto through another gate; a pond provided longitudinally in parallel with and adjacent to said hull joining stage on the water side, a longitudinal end of said pond being open to a body of water through still another gate, and the bottom surface of said pond being sufficiently lower than the bottom surface of said hull joining stage to enable a hull in said pond to float completely when the water level in said pond becomes flush with the level of the body of water by introducing water from the body of water into said pond; cranes travelling linearly along said hull joining stage, said stern building stage, and said bow and parallel body building stage; and partition walls comprehensively enclosing said hull joining stage and said pond in water-tight manner in conjunction with said three gates, said partition walls and said three gates being sufficiently higher than the ground level and the level of waters to enable a hull in said hull joining stage to float completely on introducing water from the body of water into both said hull joining stage and said pond.

DETAILED DESCRIPTION OF PREFERRED EMBODIMENTS

The building equipment of hull of this invention is described with reference to the accompanying drawings.

Figure 1:
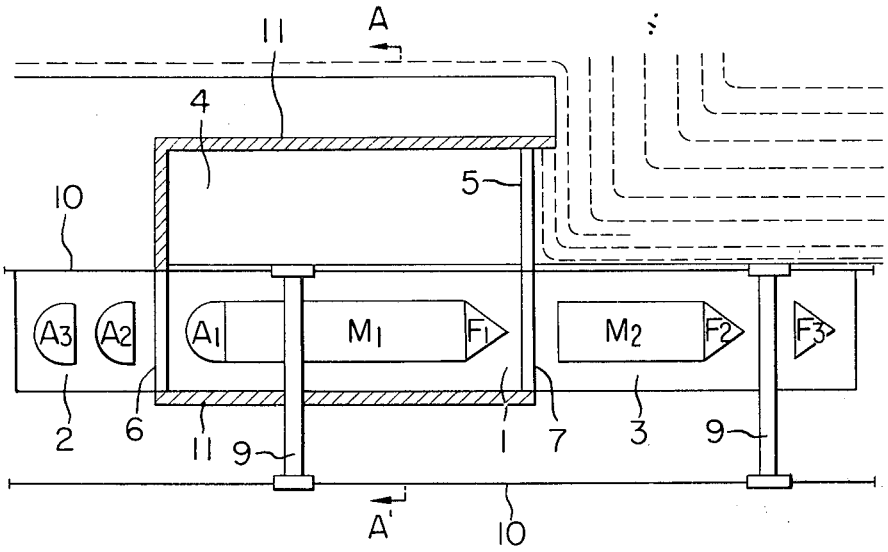
FIG. 1 is a plan view which schematically illustrates an embodiment of the building equipment for a hull of this invention.
Figure 2:
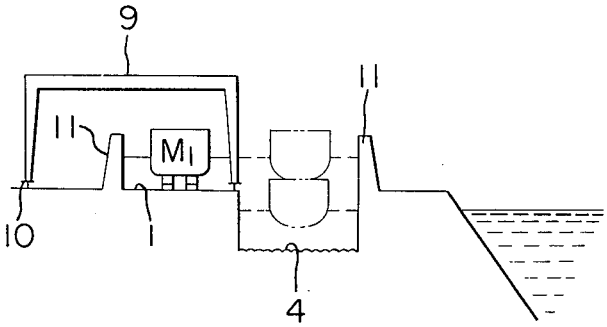
FIG. 2 is a sectional view taken along line A – A′ in FIG. 1.

FIG. 1 is a plan view which illustrates an embodiment of the building equipment for a hull of this invention, and FIG. 2 is a sectional view taken along line A – A′ in FIG. 1. As shown in said two drawings, the building equipment for a hull of this invention comprises a hull joining stage 1, a stern building stage 2, a bow and parallel body building stage 3, a pond 4, a first gate 5, a second gate 6, a third gate 7, cranes 9, crane rails 10 and partition walls 11.

A hull joining stage 1 is, as shown in FIG. 2, a ground dock having a horizontal bottom surface level flush with the ground level of the site, and the second gate 6 and the third gate 7 are provided at the longitudinal ends of the hull joining stage 1, respectively. As mentioned later, the site for the building equipment for a hull of this invention is located along the waters such as a sea, lake or river (hereinafter referred to as "sea") and is generally higher than the sea level. However, a site enclosed by embankments and being lower than the sea level may be used.

A stern building stage 2 is provided at a longitudinal end of said hull joining stage 1 so as to be adjacent thereto through said second gate 6. Said stern building stage 2 has a horizontal bottom surface level flush with the bottom surface of said hull joining stage 1.

A bow and parallel body building stage 3 is provided at the other longitudinal end of said hull joining stage 1 so as to be adjacent thereto through said third gate 7. Said bow and parallel body building stage 3 has a horizontal bottom surface level flush with the bottom surface of said hull joining stage 1. As apparent from the foregoing, said hull joining stage 1, said stern builing stage 2 and said bow and parallel body building stage 3 are all installed on the ground and have a horizontal bottom surface on the same level. Said stern building stage 2 and said bow and parallel body building stage 3 face each other at longitudinal ends of said hull joining stage 1, with said hull joining stage 1 between.

A pond 4 is provided longitudinally in parallel with and adjacent to said hull joining stage 1 on the sea side. There is neither partition wall nor gate between said hull joining stage 1 and said pond 4. The bottom of said pond 4 may be the natural seabed without reinforcement work or the conventional dock may be used as said pond 4. However, the bottom surface of said pond 4 must be, as described later, sufficiently lower than that of said hull joining stage 1 to enable a hull in said pond 4 to float completely when the water level in said pond 4 becomes flush with the sea level by introducing sea water into said pond 4. A longitudinal end of said pond 4 is open to the sea through a first gate 5, and the other end is, as described later, closed by a partition wall 11.

For example, two cranes 9 such as gantry cranes are provided, and travel linearly and freely on crane rails 10 between said stern building stage 2 and said bow and parallel body building stage 3 through said hull joining stage 1.

Partition walls 11 are so provided as to comprehensively enclose said hull joining stage 1 and said pond 4 in water-tight manner in conjunction with said first gate 5, said second gate 6 and said third gate 7, that is: said partition walls 11 form the longitudinal side wall of said hull joining stage 1 on the land side, the longitudinal side wall of said pond 4 on the sea side and the lateral side wall of said pond facing said first gate 5. Said partition walls 11, said first gate 5, said second gate 6 and said third gate 7 must be, as described later, sufficiently higher than the ground level and the sea level to enable a hull in said hull joining stage 1 to float completely on introducing sea water into both said hull joining stage 1 and said pond 4.

In the building equipment for a hull of the above-mentioned structure of this invention, buidling of hulls is effected as follows:

Building of a stern $A_1$ requiring a relatively long building period is first started in the stern building stage 2, and building and joining of a bow $F_1$ and a parallel body $M_1$ requiring a relatively short building period is then started in the bow and parallel body building stage 3. Said stern $A_1$ built in said stern building stage 2 is transferred to the hull joining stage 1 through the opened second gate 6 by the use of transfer means such as the cranes 9 or carriages (not shown). Said bow and said parallel body $F_1 + M_1$ built and joined in said bow and parallel body building stage 3 are also transferred to said hull joining stage 1 through the opened third gate 7 by the use of transfer means such as said cranes 9 or carriages (not shown). Then, said stern $A_1$ is joined to said bow and parallel body $F_1 + M_1$ to complete the hull $A_1 + F_1 + M_1$ in said hull joining stage 1. In the respective steps mentioned above, said cranes 9 such as gantry cranes travel linearly and freely on the crane rails 10 along said hull joining stage 1, said stern buiding stage 2 and said bow and parallel body building stage 3 to ensure efficient building of hulls.

When joining of said stern $A_1$ to said bow and said parallel body $F_1 + M_1$ in said hull joining stage 1 is completed in the way as mentioned above, the first gate 5, the second gate 6 and the third gate 7 are closed, and the hull joining stage 1 and the pond 4 are flooded with sea water by means of pumps (not shown), etc., or, when the site is lower than the sea level, by utilizing a high tide to cause said hull $A_1 + F_1 + M_1$ to float as shown in FIG. 2 and then to transfer said hull laterally to said pond 4.

Next, the water in said hull joining stage 1 and said pond 4 is discharged substantially completely or at least to a level below the bottom surface of said hull joining stage 1. Therefore, in said hull joining stage 1, it is possible to immediately start joining of the next hull. In the case where the bottom of said pond 4 is not reinforced, outfit work is effected in said pond 4 with said hull $A_1 + F_1 + M_1$ floating. When the known dock is used as said pond 4, operations up to the final ones including outfitting is carried out in said pond 4.

When outfit work and other work of the hull $A_1 + F_1 + M_1$ in said pond 4 are completed, said pond 4 is flooded with sea water to a level corresponding to the sea level to float said hull $A_1 + F_1 + M_1$, or this flooding step is omitted when the water in said pond 4 remains at a level corresponding to the sea level. Then, said hull $A_1 + F_1 + M_1$ is towed out from said pond 4 onto the sea through said opened first gate 5. On this occasion, if lateral transfer of the next hull built in accordance with the above-mentioned process from said hull joining stage 1 to said pond 4 and towing-out of the previously built hull from said pond 4 onto the sea are simultaneously effected by utilizing a high tide or by arranging beforehand the bottom surface of said hull joining stage 1 and that of said pond 4 with due considerations to the sea level, further improvement is possible in efficiency of building hulls.

FIG. 1 illustrates building of the first vessel, the second vessel, the third vessel, and so forth in accordance with the above-mentioned process using the building equipment for a hull of this invention. In the drawing, the vessel number represents the order of completion of vessels. In said hull joining stage 1, the stern $A_1$ of the first vessel built in said stern building stage 2 and transferred to said hull joining stage 1 is being joined to the bow and parallel body $F_1 + M_1$ of the first vessel built and joined together in said bow and parallel body building stage 3 and transferred to said hull joining stage 1. Simultaneously with this building process, the sterns $A_2$ and $A_3$ of the second and third vessels are being built in said stern building stage 2, and the bow $F_2$ and parallel body $M_2$ of the second vessel are being joined and the bow $F_3$ of the third vessel is being built in said bow and parallel body building stage 3.

Figure 3:
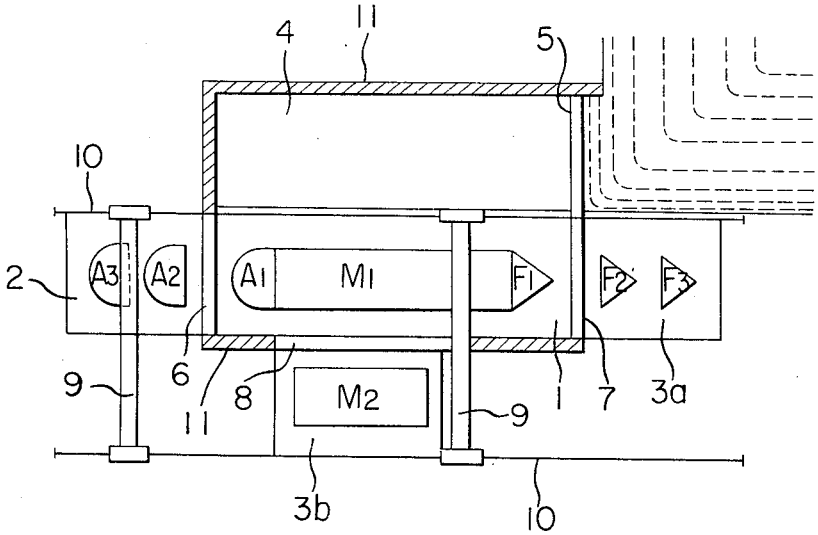
FIG. 3 is a plan view which schematically illustrates another embodiment of the building equipment for a hull of this invention.
Figure 4:
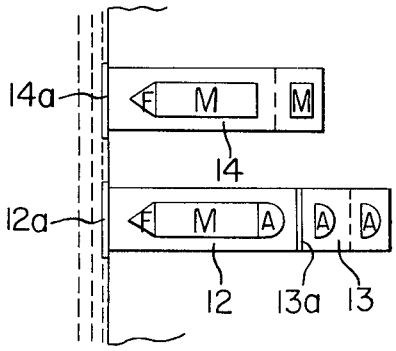
FIG. 4 is a schematic plan view of the conventional method of building hulls using two docks.

Next, another embodiment of the building equipment for a hull according to this invention is described with reference to FIG. 3. In the drawing, 3*a* designates a bow building stage, 3*b* designates a parallel body building stage, 8 designates a fourth gate, and other reference numerals correspond to those in FIG. 1. In this embodiment, the bow and parallel body building stage 3 of FIG. 1 is devided into two parts, namely: a bow building stage 3*a* and a parallel body building stage 3*b*.

A bow building stage 3*a* is provided at the other longitudinal end of the hull joining stage 1 so as to be adjacent thereto through the third gate. Therefore, said bow building stage 3*a* and the stern building stage 2 face each other at longitudinal ends of said hull joining stage 1, with said hull joining stage 1 between. Said bow building stage 3*a* has a horizontal bottom surface level flush with the bottom surface of said hull joining stage 1.

A parallel body building stage 3*b* is provided longitudinally in parallel with and adjacent to said hull joining stage 1 on the land side through a fourth gate 8 arranged in the longitudinal side wall of the partition walls 11 on the land side. Therefore, said parallel body building stage 3*b* and the pond 4 face each other at the lateral ends of said hull joining stage 1, with said hull joining stage 1 between. Said parallel body building stage 3*b* has a horizonal bottom surface level flush with the bottom surface of said hull joining stage 1. As is apparent from the foregoing, said bow building stage 3*a* and said parallel body building stage 3*b* are installed on the ground and have a horizontal bottom surface level flush with the bottom surface of said hull joining stage 1.

In this embodiment, only bows are built in said bow building stage 3*a* and only parallel bodies are built in said parallel body building stage 3*b*. The built bow and the built parallel body are transferred to said hull joining stage 1 through said opened third gate and said opened fourth gate by the use of transfer means such as cranes and carriages (not shown). In said hull joining stage 1, said bow and parallel body are joined together and, at the same time, the stern is joined as already mentioned, to complete the hull. When said hull joining stage 1 and said pond 4 are flooded with sea water, also said fourth gate 8 is closed in addition to the first gate 5, the second gate 6 and the third gate 7. Other steps are quite the same in the above-mentioned embodiment.

Furthermore, it is possible to raise the productivity of hull building by installing further the same stages outside said stern building stage, said bow and parallel body building stage, said bow building stage and/or said parallel body building stage, respectively, in still another embodiment.

The building equipment for a hull of this invention as amplified above has such advantages as mentioned below and largely improves the efficiency of building of hulls, thus producing industrially useful effect.

a. Transfer of each part of a hull from stage to stage and from stage to pond is effected only in the building equipment of hull, thus eliminating the necessity of transferring by sea. Therefore, hull building operation is substantially free of the influence of the weather such as winds and waves, thus minimizing required time and labor.

b. Since all stages and pond are arranged in a rational manner, cranes such as gantry cranes can be effectively used, thus reducing the number of necessary cranes.

c. Every stage except for the pond has a horizontal bottom surface level flush with the ground level of the hull block manufacturing shop. It is therefore possible, by using carriages, to transfer from the block manufacturing shop to a stage and between stages huge blocks weighing several tens of thousands tons, uncapable of being lifted by a giant crane.

d. Building operations of hull can be conducted without transfer of such facilities as welding machines, painting apparatus, scaffolding, and power source, because these operations are appropriately distributed to stages and pond and facilities are individually installed in stages and pond by designing them to suit respective operations in stages and pond.

What is claimed is:

1. Building equipment for a ship's hull located on land adjacent a body of water, comprising: a hull joining stage having a substantially horizontal bottom surface level substantially flush with the ground level of the site and having a first longitudinal side facing the body of water and a second longitudinal side facing the land; a stern building stage having a substantially horizontal bottom surface level substantially flush with the bottom surface of said hull joining stage, provided at a longitudinal end of said hull joining stage so as to be adjacent thereto through a gate; a bow and parallel body building stage having a substantially horizontal bottom surface level substantially flush with the bottom surface of said hull joining stage, provided at the other longitudinal end of said hull joining stage so as to be adjacent thereto through another gate; a pond provided longitudinally and substantially in parallel with and adjacent to said hull joining stage on the water side, a longitudinal end of said pond being open to the body of water through still another gate, and the bottom surface of said pond being sufficiently lower than the bottom surface of said hull joining stage to enable a hull in said pond to float completely when the water level in said pond becomes flush with the level of the body of water by introducing water from the body of water into said pond; cranes travelling substantially linearly along said hull joining stage, said stern building stage, and said bow and parallel body building stage; and partition walls comprehensively enclosing said hull joining stage and said pond in a water-tight manner in conjunction with said three gates, said partition walls and said three gates being sufficiently higher than the ground level and the level of the body of water to enable a hull in said hull joining stage to float completely on introducing water from the body of water into both said hull joining stage and said pond.

2. The building equipment for a hull of claim 1, wherein said bow and parallel body building stage is divided into a bow building stage and a parallel body building stage; said bow building stage having a substantially horizontal bottom surface level substantially flush with the bottom surface of said hull joining stage, being provided at the other longitudinal end of the hull joining stage so as to be adjacent thereto through the gate; and said parallel body building stage having a substantially horizontal bottom surface level substantially flush with the bottom surface of said hull joining stage, being provided substantially longitudinally in parallel with and adjacent to said hull joining stage on the land side through a gate arranged in the longitudinal side wall of the partition walls on the land side.

* * * * *